US007874152B2

(12) United States Patent
Pfaff

(10) Patent No.: US 7,874,152 B2
(45) Date of Patent: Jan. 25, 2011

(54) HYDRAULIC SYSTEM WITH COMPENSATION FOR KINEMATIC POSITION CHANGES OF MACHINE MEMBERS

(75) Inventor: Joseph L. Pfaff, Wauwatosa, WI (US)

(73) Assignee: INCOVA Technologies, Inc., Waukesha, WI (US)

( * ) Notice: Subject to any disclaimer, the term of this patent is extended or adjusted under 35 U.S.C. 154(b) by 495 days.

(21) Appl. No.: 12/113,517

(22) Filed: May 1, 2008

(65) Prior Publication Data

US 2009/0272109 A1 Nov. 5, 2009

(51) Int. Cl.
*F15B 11/00* (2006.01)
*E02F 9/22* (2006.01)

(52) U.S. Cl. ..... 60/461; 91/454

(58) Field of Classification Search ..... 60/368, 60/433; 91/361, 364, 454, 459; 701/50
See application file for complete search history.

(56) References Cited

U.S. PATENT DOCUMENTS 5,699,247 A * 12/1997 Moriya et al. ..... 701/50
6,328,275 B1 12/2001 Yang et al.
6,356,829 B1 * 3/2002 Fan et al. ..... 701/50
6,718,759 B1 4/2004 Tabor
6,951,102 B2 10/2005 Tabor
7,251,935 B2 * 8/2007 Zhang et al. ..... 60/461
7,270,046 B2 * 9/2007 Stephenson et al. ..... 91/454
7,729,833 B2 * 6/2010 Brickner et al. ..... 701/50

* cited by examiner

*Primary Examiner*—Thomas E Lazo
(74) *Attorney, Agent, or Firm*—Quarles & Brady LLP; George E. Haas

(57) ABSTRACT

A machine, such as a backhoe, has a series of components connected in series and moved by separate hydraulic actuators. A position estimator determines the present position of each component from the load acting on the associated hydraulic actuator and a velocity command for the component. For each component, a function parameter estimator uses the present positions of the components to derive a set of parameters that include a static structure load that the components exert on the associated hydraulic actuator, acceleration and deceleration limits for both directions of component motion, and a control bandwidth for the associated hydraulic actuator. The set of parameters for a given component is used to control the associated hydraulic actuator.

23 Claims, 3 Drawing Sheets

HYDRAULIC SYSTEM WITH COMPENSATION FOR KINEMATIC POSITION CHANGES OF MACHINE MEMBERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a hydraulic system for operating components of a machine, and more particularly to such systems for machines, such as a backhoe with a boom assembly for example, in which the hydraulic load varies as a function of the position of the components being operated.

2. Description of the Related Art

A wide variety of machines have moveable members which are driven by a hydraulic actuator, such as a cylinder-piston arrangement or a hydraulic motor. For example, a backhoe has a tractor on which is mounted an assembly comprising a boom, an arm, an extender, and a bucket connected in series, with each of those components being driven by one or more cylinder-piston arrangement. That assembly swings left and right with respect to the tractor when driven by another cylinder-piston arrangement. The flow of fluid to and from each hydraulic actuator is controlled by a separate electrically operated valve assembly, which along with the actuator form a hydraulic function.

The hydraulic control is distributed throughout the machine by locating the valve assembly for a given hydraulic function in close proximity to the associated hydraulic actuator. Such distributed control reduces the amount of plumbing on the machine. A single hydraulic fluid supply conduit and a single fluid return conduit connect all the valve assemblies to the pump and tank on the tractor 18.

Today the hydraulic valve assemblies comprise one or more electrohydraulic valves which often are operated by a computer system. The operator in the cab of the backhoe manipulates joysticks or other input devices to generate electrical control signals for operating the valve assemblies located adjacent each hydraulic actuator. U.S. Pat. No. 6,718,759 describes a velocity based system for controlling a hydraulic system with multiple functions in which a velocity command is produced from a joystick signal. The velocity command and other signals for a given machine function are transmitted over a shared communication network to a separate function controller that is associated with the valve assembly which controls the hydraulic actuator for that machine function. Each function controller is located in close proximity to the associated valve assembly. The function controllers also send data and other messages over the communication network to the system controller.

Each hydraulic machine function in an electrically controlled hydraulic system has a parameter known as bandwidth. The bandwidth characterizes how well the hydraulic machine function responds to electrically commanded operations. As the frequency of the commands increase, a point occurs at which the hydraulics can no longer supply enough force to control the velocity to command signal frequency and thus the velocity begins to lag the command. That frequency point defines the bandwidth of the hydraulic machine function. The bandwidth of a given hydraulic machine function is dynamic being affected by different operating conditions, a significant one of which is the inertia of the load acting on the actuator. The greater the inertia, the higher the hydraulic force required to accelerate the function to a command velocity and thus the maximum acceleration that can be controlled is limited. The inertia of the boom assembly on a backhoe varies as the positions of the various components of that assembly change thereby altering the instantaneous bandwidth of the associated actuators. In addition the ability of the hydraulics to apply torque to this inertia changes with the position of the structures and also affects the instantaneous bandwidth of the associated actuators.

If the instantaneous bandwidth could be determined, the controller would be able adjust the commanded operation of the hydraulic actuators to achieve increased controllability. For example, attempting to operate the hydraulic actuator faster than it is able to respond, produces jerky motion of the associated machine component, however commanding the hydraulic actuator to operate slower than it is able, unnecessarily diminishes machine performance. Therefore, it is desirable to know the instantaneous bandwidth of each hydraulic machine function.

Controllability of the machine is paramount for achieving productive and efficient operation. Modern hydraulic systems have a variety of measured and sensed pressures that are used to enable or disable different orifices, pump modes, load sense pressures, and the like to optimize the machine performance in real time. This ensures that the hydraulic system controls acceleration and deceleration or machine components at rates that are acceptable to the operator over a wide range of component positions, loads and parameters induced from the operating environment. Inevitably, the variable component positions, loads, and environmental constraints require tradeoffs to be made and such tradeoffs often involve adding extra losses (damping) to the hydraulic system to ensure that the machine operates in a stable and predictable manner.

The transition from purely mechanical controls to electrohydraulic controls on heavy equipment, such as a backhoe, simply emulated the previous hydromechanical systems. Little work has been done to date to migrate some of the previous tradeoffs that were necessary. A missing part of the transition to electrohydraulic systems is not recognizing the capability of electronics and software to integrate velocity commands to create position indications for use in machine control. Although some machines today use position feedback from sensors for position or angle control, such as bucket leveling, these systems only modulate high level commands to the hydraulic functions based on a combination of such feedback signals and operator commands. Most hydraulic systems only modulate the valves or the pump given the same velocity or joystick command very similarly to hydraulic pilot pressure or spool position has been used.

It is desired to provide a method for estimating the position of different actuators and components on the machine and then use that information on a hydraulic function by function basis to remove some of the barriers that have existed in providing truly optimal control of the machine.

In the case of a backhoe, for example, the control of the swing function, which rotates the boom assembly, is affected by how far the boom, arm and extender project from the tractor. The closer that those components are to the tractor, the lower the swing inertia for the swing function. Likewise, the farther that the components of the boom assembly extend from the backhoe tractor, the greater the load that is placed on each hydraulic actuator associated with those components. Each of the boom, arm, extender and bucket of the boom assembly has a given mass that for each combination of stationary positions of those components produces a different static structure load on each hydraulic actuator. Thus, it is useful to know the position of the boom and arm with respect to the backhoe tractor to determine how to accelerate and decelerate the swing motion.

SUMMARY OF THE INVENTION

It has been realized by the present inventor that the operating efficiency of a hydraulic system can be enhanced by taking into account an estimate of the kinematic position of the various machine components and use the position estimates to determine the load that those components place on the hydraulic system.

The hydraulic system includes a hydraulic actuator that produces movement of a machine component in response to a velocity command designating a desired velocity. Physical operating characteristics of the hydraulic system are ascertained by a method that comprises receiving the velocity command and in response to the velocity command, producing a position indication denoting a present position of the machine component.

In a preferred embodiment, the position indication is produced by acquiring a load indication, that denotes the hydraulic load of the hydraulic actuator. The load indication is employed to produce a proportion value, that designates the ability of the hydraulic system to operate the hydraulic actuator to achieve the commanded velocity. The proportion value is applied to the velocity command, thereby deriving a proportioned velocity command which then is integrated to generate the position indication.

The general method of the present invention utilizes the position indication to, derive a parameter set that preferably comprises at least one of a value indicating a static structure load that the mass of the machine component exerts on the hydraulic actuator, an acceleration limit of the hydraulic actuator, a deceleration limit of the hydraulic actuator, and a bandwidth of operation of the hydraulic actuator. Different acceleration and deceleration limits and the bandwidths may be derived for different commanded movement in opposite directions, since an actuator has different force limitations for each direction of motion. The hydraulic actuator then is operated in response to the parameter set.

In the preferred embodiment, derivation of the parameter set comprises addressing a first look up table with the position indication to produce the value indicating the static structure load. The position indication also is used to address both a second look up table to produce a torque value and a third look up table to produce an inertia value.

For a machine, such as a backhoe for example, that has a plurality of components connected together and movable with respect to each other by a plurality of hydraulic actuators, the method derives physical operating parameters for each hydraulic actuator. An indication of the present position of each machine component is produced and those present position indications are employed in deriving the parameter set. As noted previously, the parameter set for each machine component includes one or more of a structure load value, an acceleration limit of the hydraulic actuator, a deceleration limit of the hydraulic actuator, and a bandwidth for each direction of commanded motion of the hydraulic actuator. Preferably, all of those parameters are produced for every hydraulic actuator associated with the machine components.

DETAILED DESCRIPTION OF THE INVENTION

Figure 1:
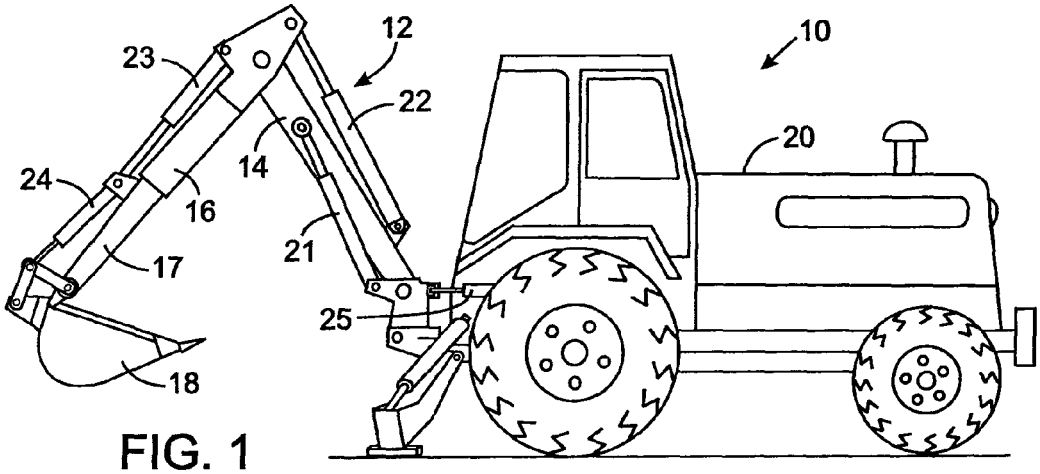
FIG. 1 is an isometric view of a backhoe that incorporates a hydraulic system according to the present invention.

With initial reference to FIG. 1, a backhoe 10 has a hydraulically powered work apparatus 12, commonly known as a boom assembly, that comprises a boom 14, arm 16, an extender 17, and a bucket 18. The bucket 18 can be replaced by another type of implement. Operations performed by work apparatus 12 include, for example, lifting, lowering, and otherwise moving a load carried in the bucket. The boom 14 has one end pivotally mounted to the backhoe tractor 20 and is raised and lowered by a first, or boom, hydraulic actuator 21. The arm 16 connected to pivot at the opposite end of the boom 14 under force applied by a second, or arm, hydraulic actuator 22. The extender 17 is telescopically extended from and retracted into the arm 16 by a third hydraulic actuator 23, also called an extender actuator. A fourth, or bucket, actuator 24 pivots the bucket 18 that is attached at the remote end of the extender 17. A fifth hydraulic actuator 25 swings the work apparatus 12 with respect to the back of the tractor 20. The five hydraulic actuators 21-25 are double-acting cylinder and piston arrangements configured to receive and convert pressurized hydraulic fluid into mechanical force for bidirectionally moving the associated backhoe component. However the present invention can be used with other types of actuators, such as a hydraulic motor for example. Therefore as used herein, a hydraulic actuator is a generic term that includes a cylinder and piston arrangement, a hydraulic motor, and other devices that receive pressurized hydraulic fluid and produce mechanical force and motion. For further ease of explanation, a cylinder-piston arrangement often is simply referred to as a cylinder.

Figure 2:
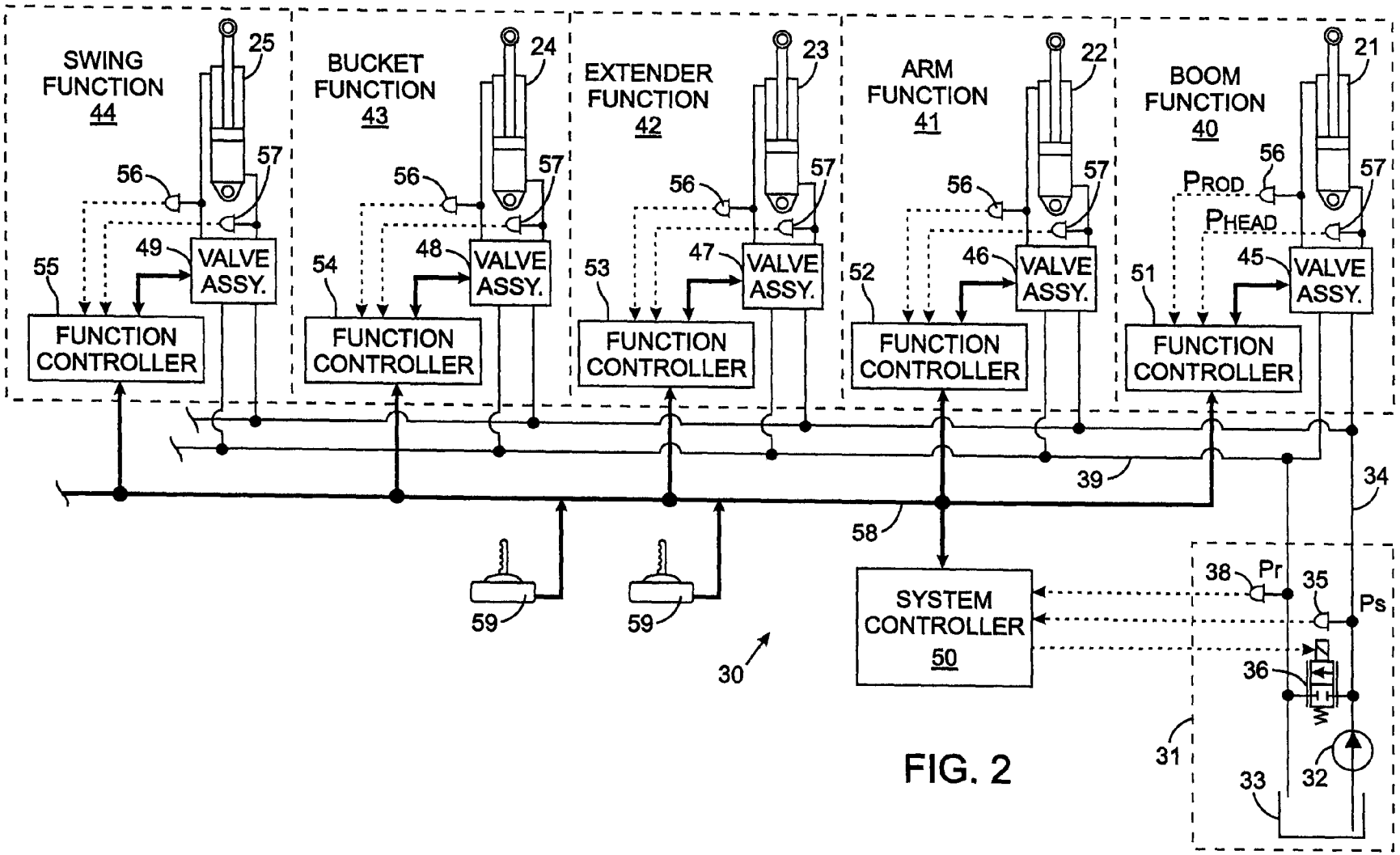
FIG. 2 is a schematic diagram of the hydraulic system.

With reference to FIG. 2, the five hydraulic actuators 21-25 are part of a hydraulic system 30 that has a fixed displacement pump 32 which draws fluid from a tank 33 and forces that fluid under pressure into a supply conduit 34. The supply conduit 34 furnishes pressurized fluid to a boom function 40, an arm function 41, extender function 42, a bucket function 43, and a swing function 44, which respectively operate the boom actuator 21, the arm actuator 22, the extender actuator 23, the bucket actuator 24 and the swing actuator 25. Other hydraulic functions (not shown) also are provided for operating stabilizers and other types of implements. Fluid returns from the hydraulic functions 40-44 to the tank 33 via a return conduit 39.

The outlet pressure Ps from the pump 32 is measured by a first sensor 35, which provides a signal indicating that pressure to a system controller 50. An unloader valve 36 is electrically operated by the system controller 50 to regulate pressure in the supply conduit 34 by relieving some of the fluid to the tank 33. Other hydraulic systems utilize a variable displacement pump, that is operated by the system controller 50. The system controller 50 also receives a signal from a second pressure sensor 38 that measures the pressure Pr in the tank return conduit 39.

Each hydraulic function 40-44 includes one of the hydraulic actuators, a valve assembly, and an electronic function controller. Specifically, the boom function 40 has a first valve assembly 45 that selectively applies the pressurized fluid from the supply conduit 34 to one of the cylinder chambers of the boom actuator 21 and drains fluid from the other cylinder chamber to the return conduit 39. A second valve assembly 46 in the arm function 41 controls the flow of hydraulic fluid between the arm actuator 22 and the supply and return conduits 34 and 39. The extender function 42 has a third valve assembly 47 controlling fluid flow to and from the rod and head chambers of the extender actuator 23. The supply and tank conduits 34 and 39 are coupled to the chambers of the bucket actuator 24 by a fourth valve assembly 48. A fifth valve assembly 49 in the swing function 44 selectively couples the swing actuator 25 to the supply and return conduits 34 and 39. The valve assemblies selectively apply pressurized fluid from the supply conduit 34 to the head chamber of the associated hydraulic actuator to move the associated backhoe component in one direction and apply that fluid to the rod chamber to move the backhoe component in the opposite direction. Each valve assembly 45-49 is located adjacent the respective hydraulic actuator 21-25 to form a distributed control system. Each valve assembly 45-49 may comprise any conventional configuration of one or more electrical operated valves, such as the Wheatstone bridge configuration disclosed in U.S. Pat. No. 6,951,102, which may use electrohydraulic poppet valves described in U.S. Pat. No. 6,328,275.

Operation of the valve assemblies 45, 46, 47, 48 and 49 is controlled by a separate function controller 51, 52, 53, 54 and 55, respectively. Each function controller 51-55 preferably is co-located with the associated valve assembly along the work apparatus 12. The function controllers 51-55 receive operational commands from the system controller 50 and the operator joysticks 59, and exchange data with the system controller and the other function controllers. Those commands and data are sent via a standard communication network 58, such as the Controller Area Network (CAN) serial link. Communication network 58 also carries other messages between sensors and controls for the engine, transmission, and other components on the backhoe 10.

The system controller 50 and the function controllers 51-55 incorporate microcomputers that execute software programs which perform specific tasks assigned to the respective controller. The system controller 50 supervises the overall operation of the hydraulic system 30. To produce movement of a given hydraulic actuator 21-25 on the work apparatus 12, the backhoe operator manipulates the corresponding joystick 59 to produce a command that indicates the movement desired. Each joystick 59 has circuitry that transmits its command via the communication network 58 to the particular function controller 51, 52, 53, 54 or 55 that operates the respective hydraulic actuator 21, 22, 23, 24 or 25. The joystick commands also are received by the system controller 50.

Each hydraulic function 40, 41, 42, 43 and 44 has a first pressure sensor 56 that measures the pressure $P_{ROD}$ in the line connected to the rod chamber of the respective hydraulic actuator 21, 22, 23, 24 or 25 and has a second pressure sensor 57 that measures the pressure $P_{HEAD}$ in the line connected to the head chamber of that actuator. The signals produced by these pressure sensors are sent to the function controller for the associated hydraulic function.

Figure 3:
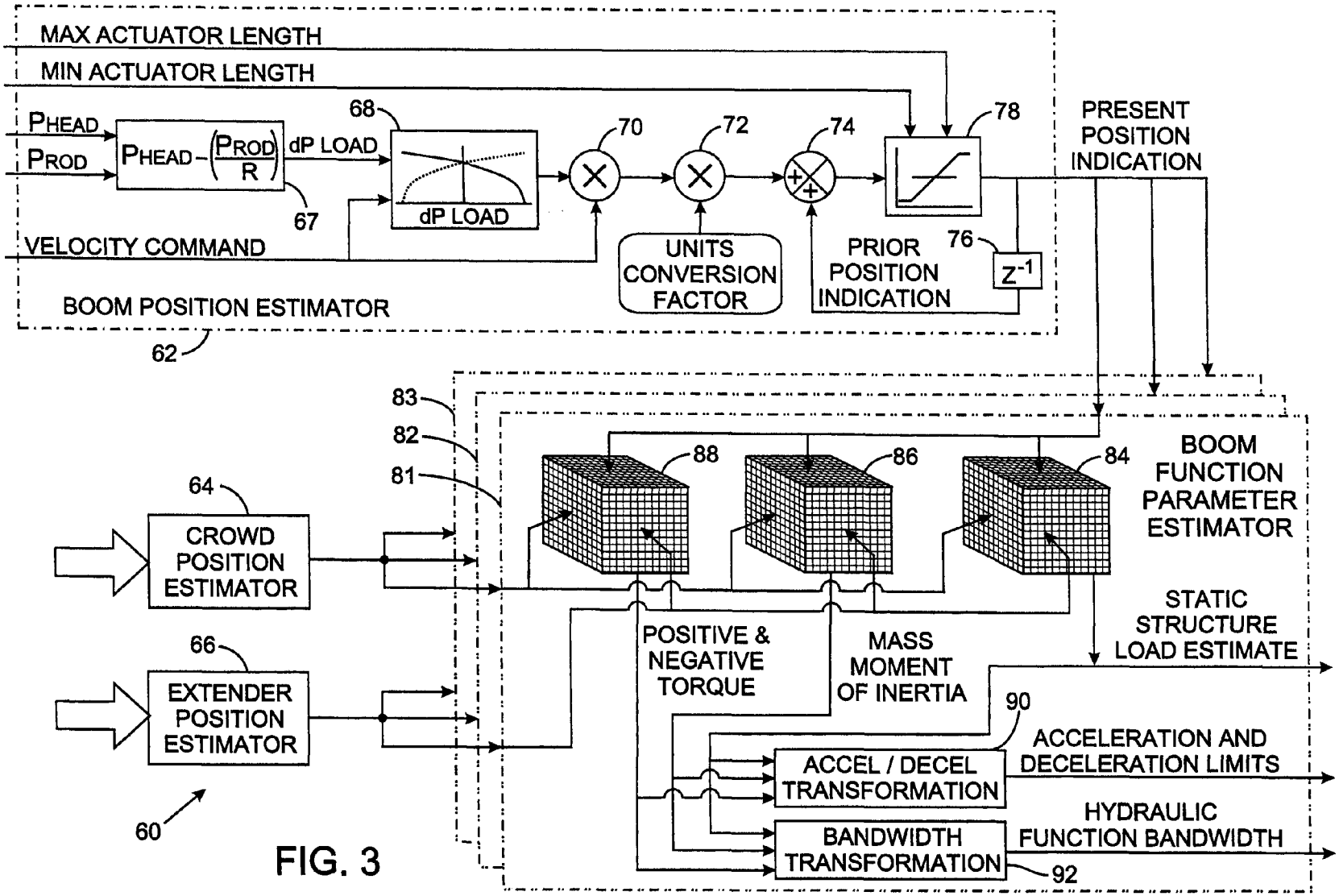
FIG. 3 is a functional diagram of a routine that is executed by an electronic controllers to determine the instantaneous bandwidth of each hydraulic function of the backhoe.

With reference to FIG. 3, the function controllers 51-53 for the boom, crowd and extender functions 40-42 collectively execute a software program 60 at regular intervals, each called an execution cycle. The software program provides estimated indications of the positions of the associated machine components (boom, arm, or extender) and uses those position indications to derive an estimate of the bandwidth of the three hydraulic functions and estimates of the rates at which the associated hydraulic actuators can be accelerated and decelerated in each direction of motion. The software program 60 includes a boom position estimator that is executed by the function controller 51 in the boom function 40 to provide an indication of the position of the boom relative to the backhoe tractor 20. Also included is a functionally identical arm position estimator 64 which the function controller 52 for the arm function 41 executes to produce an indication of the position of the arm 16 relative to the boom 14. A third position estimator 66, executed by the extender function controller 53, determines the relative position of the extender 17 with respect to the arm 16. In the preferred embodiment, a position estimator is not provided for the bucket function 43, because the position of the bucket has a relatively small affect on the inertia of the work apparatus 12. Nevertheless, a similar position estimator could be provided for the bucket function 43, especially if that function operates another type of implement, the positions of which have a greater effect on the work apparatus inertia. The swing function does not affect the static load or the inertia of the work apparatus 12.

Because the three position estimators 62, 64 and 66 are functionally identical, except for operating on different data, the operation of only the boom position estimator 62 will be described in detail with the understanding that this description applies to the other two position estimators 64 and 66. The boom position estimator 62 receives the head chamber pressure $P_{HEAD}$ and rod chamber pressure $P_{ROD}$ of the boom hydraulic actuator 21 from sensors 56 and 57 (FIG. 2) and, in processing stage 67, calculates hydraulic load on the boom function using the equation $dPload = P_{HEAD} - P_{ROD}/R$, where R is the ratio of piston surface area in the head chamber area to the piston surface area in the rod chamber area.

The hydraulic load value is applied to a proportioning function 68, along with the boom actuator velocity command derived by the function controller 51 from an operator input received from the associated joystick 59. The proportioning function 68 determines a proportion value (from zero to one) which indicates the responsiveness and ability of the hydraulic system to operate the boom hydraulic actuator 21 to achieve the commanded velocity. Note that a proportion value greater than one may be used in some situations, such as to offset less than perfect pressure compensation on an overrunning load. When a positive velocity is being commanded, production of the proportion value is defined by a first transformation function, depicted by the solid curve in FIG. 3, and when a negative velocity is commanded that production is defined by a second transformation function, depicted by the dotted curve. The proportioning function 68 also ensures that the velocity command is processed only if the hydraulic load is within the machine's ability to achieve that commanded velocity. For instance, if the hydraulic load of the boom function is greater than the maximum level that the pump 32 can satisfy, then the boom 14 is not moving and thus the commanded velocity cannot be achieved. In that situation, the proportion value is zero which in effect disables the boom position estimator 62 from producing a new position estimate, maintaining the previous position indication, until either the pressure condition or velocity command changes.

The proportion value is applied to one input of a first multiplier 70 which receives the velocity command at another input. The arithmetic product delivered by the first multiplier 70 is a proportioned velocity command representing the velocity that can be achieved by the boom hydraulic actuator 21 under the present hydraulic load. The proportioned velocity command is sent to an input of a second multiplier 72 with another input that receives a unit conversion factor. For example, the proportioned velocity may be in terms of a given distance per unit time (e.g. kilometers per hour), while integration to produce a position indication requires the units be converted to distance moved per execution cycle of the function controller 51. The result of the conversion, a distance traveled in an execution cycle, is applied to an input of an integrator 74 in the form of an adder that sums the previous position estimate with the incremental change in distance during the last execution cycle, thereby producing an indication of the position of the boom 14. The previous position indication is provided by a delay circuit 76, which delays the output from the boom position estimator 62 by one execution cycle of the function controller 51.

The new position indication at the output of the integrator 74 then is applied to a limiter 78 which also receives constants denoting the minimum and maximum lengths of the cylinder-piston assembly that forms the boom actuator 21. This limits the position indication to the range of physically possible lengths of the boom actuator 21. The limiter 78 also resets the boom position estimator 62 when the boom actuator 21 strikes either end of its stroke. In addition, a sensor is preferably provided to detect when the boom actuator 21 is at the midpoint of its stroke to correct the boom position indication for any drift between the derived position indication and the actual boom actuator position that may occur over an extended period of machine operation.

The position indication derived for a given hydraulic function 40-42 is stated as being the position of the component of the backhoe (i.e., the boom, the crowd, or the extender), however that position indication actually corresponds to the position of the hydraulic actuator for that component (i.e. the actuator length). Because the hydraulic actuator length is geometrically related to the position of the component, the position of the hydraulic actuator indicates the position of the machine component and vice versa. Therefore, those terms may be used interchangeably. In addition, since the hydraulic actuator is attached to a machine component, the velocity of one of them is related to the velocity of the other.

The present position indication of the boom 14 is communicated via the network 58 to the function controllers 52 and 53 for the arm function 41 and the extender function 42, respectively, that execute parts of the software program 60. Each of those other function controllers 52 and 53 has a similar position estimator 64 and 66, respectively, to determine the position of the arm 16 and the extender 17 and those position indications also are communicated among the three function controllers 51-53.

Each function controller 51, 52, and 53 for the three relevant hydraulic functions 40, 41 and 42 also executes a function parameter estimator 81, 82 and 83, respectively as part of the software program 60. The three function parameter estimators 81-83 are functionally identical but are individually configured to derive a set of parameters based on the kinematic characteristics of its particular machine component, i.e., the boom 14, the arm 16, or the extender 17. Because the three function parameter estimators 81-83 are functionally identical, only the estimator 81 for the boom function 40 will be described in detail with the understanding that the description applies to the other two function parameter estimators 82 and 83.

The boom function parameter estimator 81 produces a set of parameters comprising a value indicating the static structure load that the mass of the machine components exerts on the boom actuator 21, acceleration and deceleration limits for motion in each direction of the boom actuator, and a control bandwidth in each direction of the boom function 40. The initial section of the estimator operation derives values for the static structure load, mass moment of inertia, and maximum values of positive and negative torque for the boom function. Each of those three parameters is derived from a separate three-dimensional look up table 84, 86 or 88 in which each dimension corresponds to the position indication from the boom, arm and extender functions 40-42. A greater number of dimensions can be employed if additional machine functions are being considered by the estimation process. With respect to the boom assembly 12, however the principle functions affecting the static load of the work apparatus 12 are the boom, arm, and extender functions 40-42.

As noted previously, the position indications from the boom, arm and extender functions 40-42 actually designate the length of the associated hydraulic actuator, which length is geometrically related to the position of the respective machine component. The look up tables 84, 86 and 88 take those geometric and other kinematic relationships between the hydraulic actuator and the machine structure into account in deriving the parameters from the position indications. Also factored into those derivations are the maximum pump outlet pressure Ps, valve assembly pressure relief valve settings, and surface areas of piston in the respective hydraulic actuator.

The first look up table 84 receives the three position indications from estimators 62, 64 and 66 and produces an estimate of the static structure load acting on the hydraulic actuator for the given hydraulic function, in this case the boom hydraulic actuator 21. The static structure load corresponds to the force that the aggregate mass of the boom components exerts on the respective hydraulic actuator when the boom assembly is stationary. In the case of the boom hydraulic actuator 21, the masses of the boom 14, arm 16, extender 17, and bucket 18 contribute to the static structure load. Only the masses of the arm 16, extender 17, and bucket 18 contribute to the static structure load acting on the arm actuator 22. The static structure loads vary as the position of each component of the boom assembly changes, e.g., the static structure load from a given component increases as that component extends farther from the tractor of the backhoe. Therefore, the static structure load for the boom hydraulic actuator 21 is a function of the mass and position of the boom 14, arm 16, extender 17, and bucket 18. The mass of those components is factored into the values stored in the first look up table 85, which are addressed by the positions of the first three of those components. The second look up table 86 receives the same three position indications and accesses a memory location that contains the corresponding value of the mass moment of inertia. The third look up table 88 produces the positive and negative torque values for the associated machine component in a similar manner. Depending upon the size of the look up tables and whether each provides an acceptable resolution for the values of the respective parameters, the function parameter estimator 81 may include the capability to interpolate between values in the table to obtain a value most closely corresponding to that which could be derived by an equation from the three input position indications. Tables are used in the preferred embodiment for the their numerical simplicity and efficiency. The same relationships between actuator positions and these parameters can be derived through first principle physics relationships of torque, inertia, accelerations and kinematic geometric relationships on the machine.

With the estimated kinematic information and the estimated static structure load, the function controller's ability to control the velocity of the corresponding actuators also can be determined. For instance, with a given force, kinematic gain, cylinder size, and maximum supply pressure, the highest achievable acceleration rate can be calculated and then used in the control of the valve assembly and pump control. For example, if there is relatively high inertia and a high static structure load while performing a raise boom command, there is a limit to how fast the boom can be accelerated upward (without even considering the potential load in the bucket 18), because the pump pressure is not limitless. Other limits exist for the deceleration rates given the threshold settings of pressure relief valves within the valve assembly 45. From the kinematic characteristics and the pressure relief valve settings, a maximum deceleration rate for the boom function can be calculated and used by the function controller in operating that boom function. The rates for accelerating and decelerating will be different for the extend and retract operations of the corresponding hydraulic actuator 21.

Thus four limits are derived by the boom function parameter estimator 81. The output values from the three look up tables 84, 86, and 88 corresponding to the static structure load, the mass moment of inertia, and the negative torques of the boom function 40 are applied to an acceleration deceleration transformation function 90 which derives the acceleration and deceleration limits for each motion direction of the boom actuator 21.

As noted previously, the electrically controlled hydraulic functions have a given control bandwidth that corresponds to the acceptance that the load has to control inputs based on the mass moment of inertia, cylinder gain, the maximum supply pressure and relief valve settings, the static structure load and the load in the bucket. This control bandwidth can be estimated from the mechanical models delivering the mass moment of inertia, geometries of the cylinder of the boom actuator 21, the pressure relief settings and the cylinder gains. The maximum control bandwidth then is used to modulate the valve assembly 45 and control the system pump 32 within an acceptable range for the actuator. To determine the control bandwidth for the hydraulic function, the values from the three look up tables 84, 86, and 88 are applied to a bandwidth transformation function 92 which derives separate bandwidths for the extend and retract operations of the associated boom actuator 21.

As previously noted, the arm function 41 and extender function 42 have similar function parameter estimators 82 and 83 providing similar sets of values to their function controllers 52 and 53 for use in controlling their valve assemblies 45 and 46.

Figure 4:
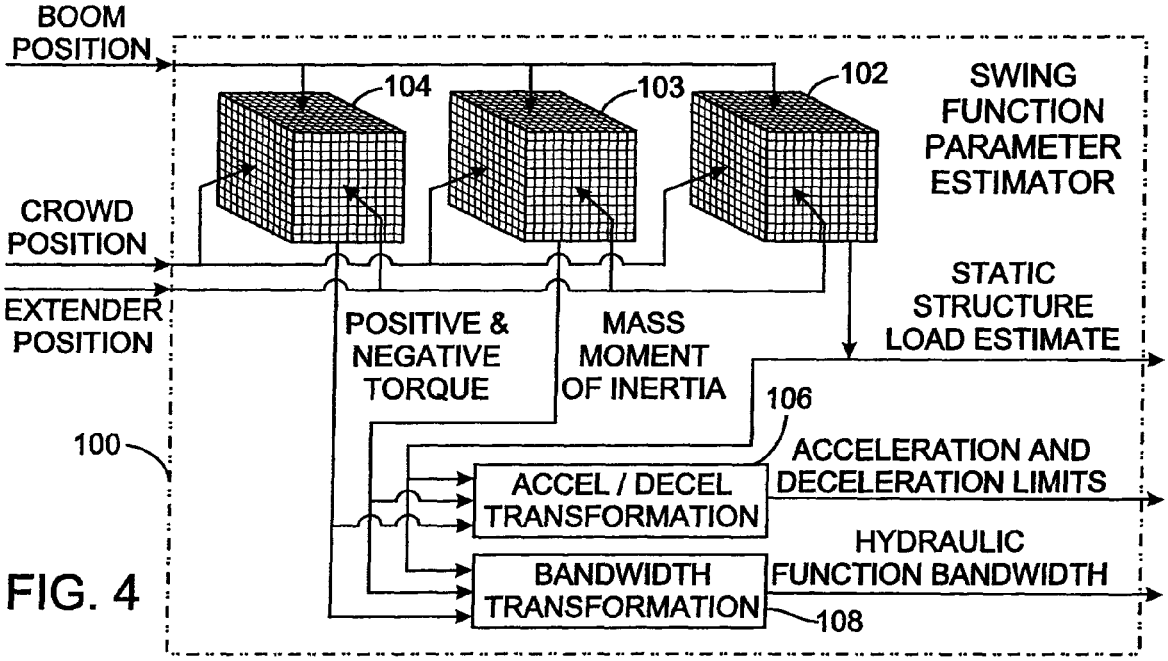
FIG. 4 is a functional diagram of a function parameter estimator used to control a boom swing hydraulic function on the backhoe.

Although the swing position of the work apparatus 12 does not affect the inertia of that implement or the load on the swing actuator 25, the dynamic position of the boom, crowd and extender do affect the swing actuator inertia and operation of the swing function 44. Therefore, while the function controller 55 for the swing function 44 does not execute a position estimator, that function controller does execute a swing function parameter estimator 100 illustrated in FIG. 4. The swing function parameter estimator 100 receives the present position indications for the boom 14, the arm 16 and the extender 17 which are communicated over the network 58 to the swing function controller 55. As in the boom function parameter estimator 81 described previously, the positions of the boom 14, the arm 16 and the extender 17 address three separate three-dimensional look up tables 102, 103 and 104 which provides values for the static load of the work apparatus 12, and the positive and negative torque values and the mass moment of inertia for the swing function 44.

The values produced by the look up tables 102, 103 and 104 are applied to an acceleration deceleration transformation function 90, which derives acceleration and deceleration limits for the swing actuator 25. Those values also are applied to a bandwidth transformation function 92 which derives separate bandwidths for the extend and retract operations of the swing actuator 25. The parameters produced by the swing function parameter estimator 100 are used by the swing function controller 55 in operating the associated valve assembly 49 to drive the swing actuator 25 and move the work apparatus 12.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A method for ascertaining physical operating characteristics of a hydraulic apparatus having a hydraulic actuator that produces movement of a machine component in response to a velocity command indicating a desired velocity, said method comprising:

receiving the velocity command;

in response to the velocity command, producing a position indication denoting a present position of the machine component;

in response to the position indication, deriving a parameter set specifying at least one physical characteristic of operation of the hydraulic actuator; and operating the hydraulic actuator in response to the parameter set.

2. The method as recited in claim 1 wherein the parameter set comprises at least one of a value for a static structure load that mass of the machine component exerts on the hydraulic actuator, an acceleration limit of the hydraulic actuator, a deceleration limit of the hydraulic actuator, and a bandwidth of operation of the hydraulic actuator.

3. The method as recited in claim 1 wherein producing a position indication comprises:

acquiring a load indication denoting magnitude of a hydraulic load associated with the hydraulic actuator;

producing a proportion value in response to the load indication; and adjusting the velocity command in response to the proportion value, thereby producing an adjusted velocity command.

4. The method as recited in claim 3 wherein producing a position indication further comprises integrating the adjusted velocity command.

5. The method as recited in claim 3 wherein acquiring a load indication comprises sensing pressures produced in two chambers of the hydraulic actuator and calculating the load indication based on those sensed pressures.

6. The method as recited in claim 1 wherein producing a position indication utilizes a previously produced position indication when the associated hydraulic actuator is incapable of moving the associated machine component.

7. The method recited in claim 1 wherein producing a position indication comprises:

acquiring a load indication denoting a hydraulic load of the hydraulic actuator;

producing a proportion value in response to the load indication;

producing a proportioned velocity command in response to the velocity command and the proportion value; and integrating the proportioned velocity command.

8. The method as recited in claim 1 wherein deriving a parameter set comprises addressing a first look up table with the position indication to produce the value indicating the static structure load.

9. The method as recited in claim 8 wherein deriving a parameter set further comprises;

addressing a second look up table with the position indication to produce a torque value; and addressing a third look up table with the position indication to produce an inertia value.

10. A method for ascertaining physical operating characteristics of a hydraulic apparatus, which has a plurality of hydraulic actuators each producing movement of one of a plurality of machine components in response to a velocity command, said method comprising steps of:

(a) producing a plurality of position indications, each of which indicates a present position of a given machine component associated with a different one of the hydraulic actuators, wherein producing each position indication uses a hydraulic load value that denotes a magnitude of a hydraulic load for the associated hydraulic actuator and uses the velocity command which denotes a desired velocity for the machine component;

(b) for one of the plurality of hydraulic actuators, responding to the plurality of position indications by deriving a parameter set comprising at least one of a structure load value denoting an amount of a static structure load exerted on that one hydraulic actuator, an acceleration limit for that one hydraulic actuator, a deceleration limit for that one hydraulic actuator, and an indication of a bandwidth of operation of that one hydraulic actuator; and (c) repeating step (b) for each other ones of the plurality of hydraulic actuators.

11. The method recited in claim 10 further comprises deriving the hydraulic load value by sensing pressures at first and second ports of the hydraulic actuator; and calculating the hydraulic load value based on those sensed pressures.

12. The method as recited in claim 10 wherein producing a position indication utilizes a previously produced position indication when the associated hydraulic actuator is incapable of moving the associated machine component.

13. The method as recited in claim 10 wherein producing a position indication for a given machine component comprises:

producing a proportion value in response to the hydraulic load value; and applying the proportion value to the velocity command for the given machine component to produce a proportioned velocity command.

14. The method as recited in claim 13 wherein producing a position indication for a given machine component further comprises integrating the proportioned velocity command.

15. The method as recited in claim 10 wherein producing a position indication for a given machine component comprises:

producing a proportion value in response to the hydraulic load value; and applying the proportion value to the velocity command for the given machine component to produce a proportioned velocity command; and integrating the proportioned velocity command to produce a position indication.

16. The method as recited in claim 10 wherein deriving a parameter set comprises addressing a first look up table with the plurality of position indications to produce the structure load value.

17. The method as recited in claim 16 wherein deriving a parameter set further comprises:

addressing a second look up table with the plurality of position indications to produce a torque value;

addressing a third look up table with the plurality of position indications to produce an inertia value; and using the torque value and the inertia value to produce at least one of an acceleration limit for that one hydraulic actuator, a deceleration limit for that one hydraulic actuator, and an indication of a bandwidth of operation of that one hydraulic actuator.

18. The method as recited in claim 10 further comprising employing the parameter set derived for a given hydraulic actuators to control the given hydraulic actuator.

19. A method for ascertaining physical operating characteristics of a hydraulic apparatus having a plurality of hydraulic actuators that produce movement of a plurality of machine components in response to velocity commands denoting a desired velocity for each machine component, said method comprising steps of:

estimating a present position of each of the plurality of machine components thereby producing a plurality of position indications, wherein estimating each present position comprises integrating the velocity command for one of the machine components; and for each one of the plurality of hydraulic actuators, responding to the plurality of position indications by deriving at least one of a static structure load value, an acceleration limit for that one hydraulic actuator, a deceleration limit for that one hydraulic actuator, and an indication of a bandwidth of operation of that one hydraulic actuator.

20. The method as recited in claim 19 wherein estimating a present position comprises for each one of the plurality of machine components:

acquiring a load indication denoting magnitude of a hydraulic load associated with the hydraulic actuator which produces movement of that one machine component;

producing a proportion value in response to the load indication; and applying the proportion value to the velocity command for that one machine component to produce a proportioned velocity command.

21. The method as recited in claim 20 wherein estimating a present position further comprises integrating the proportioned velocity command.

22. The method as recited in claim 19 wherein the deriving comprises addressing a first look up table with the plurality of position indications to produce the static structure load value.

23. The method as recited in claim 22 wherein the deriving further comprises:

addressing a second look up table with the plurality of position indications to produce a torque value;

addressing a third look up table with the plurality of position indications to produce an inertia value; and using the torque value and the inertia value to produce at least one of an acceleration limit for that one hydraulic actuator, a deceleration limit for that one hydraulic actuator, and an indication of a bandwidth of operation of that one hydraulic actuator.

* * * * *